US007481966B2

(12) United States Patent
Mizuno et al.

(10) Patent No.: US 7,481,966 B2
(45) Date of Patent: Jan. 27, 2009

(54) SYSTEM FOR SUPPLYING MOLTEN METAL, CONTAINER AND A VEHICLE

(75) Inventors: Hitoshi Mizuno, Toyota (JP); Toshio Saitoh, Toyota (JP); Takeo Imanaka, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 440 days.

(21) Appl. No.: 10/568,426

(22) PCT Filed: Jul. 20, 2005

(86) PCT No.: PCT/JP2005/013271

§ 371 (c)(1),
(2), (4) Date: Feb. 14, 2006

(87) PCT Pub. No.: WO2006/009154

PCT Pub. Date: Jan. 26, 2006

(65) Prior Publication Data

US 2008/0203629 A1 Aug. 28, 2008

(30) Foreign Application Priority Data

Jul. 22, 2004 (JP) ..... 2004-214688
May 13, 2005 (JP) ..... 2005-140714

(51) Int. Cl.
*B22D 41/58* (2006.01)

(52) U.S. Cl. ..... 266/239; 266/276

(58) Field of Classification Search ..... 266/143, 266/239, 276
See application file for complete search history.

(56) References Cited

U.S. PATENT DOCUMENTS 5,908,066 A 6/1999 Rauch (Continued)

FOREIGN PATENT DOCUMENTS

DE 2 245 571 3/1974

(Continued)

OTHER PUBLICATIONS

German PTO Official Action, Official File No. 11 2005 000 045.1-24, May 16, 2007 (4 pages) with English Translation (3 pages).

*Primary Examiner*—Scott Kastler
(74) *Attorney, Agent, or Firm*—Radar, Fishman & Grauer, PLLC

(57) ABSTRACT

A molten metal supplying system comprising a container having a main body capable of being hermetically sealed and having a passage through which compressed gas is received, a pipe having an outlet supplying molten metal in the container to the outside, the outlet downwardly extending, a reception dish receiving the molten metal capable of being placed below the pipe outlet, a holding member having a fulcrum to the pipe rotatably holding the reception dish, a wire with a first and second end, the first end connected to the reception dish or holding member, a pair of channel members at the outer bottom of the container main body, and a vehicle having a fork that can be inserted and removed from the channel members, a carriage on which the fork is mounted, a lift mechanism for lifting up and down the carriage, and a wire pull and return mechanism mounted on the carriage pulling and returning the wire with it's second end.

11 Claims, 14 Drawing Sheets

U.S. PATENT DOCUMENTS

| | | | | |
|---|---|---|---|---|
| 6,612,516 | B1 * | 9/2003 | Haines | 242/397.1 |
| 2004/0070122 | A1 * | 4/2004 | Mizuno et al. | 266/236 |
| 2004/0089987 | A1 * | 5/2004 | Kodama et al. | 266/236 |
| 2006/0048913 | A1 * | 3/2006 | Mizuno et al. | 164/337 |
| 2006/0108720 | A1 * | 5/2006 | Mizuno et al. | 266/143 |

FOREIGN PATENT DOCUMENTS

| | | | |
|---|---|---|---|
| JP | 57-37688 | A | 3/1982 |
| JP | 03-31063 | U | 3/1991 |
| JP | 2004-160538 | A | 6/2004 |
| WO | WO-03/101646 | A1 | 12/2003 |

* cited by examiner

SYSTEM FOR SUPPLYING MOLTEN METAL, CONTAINER AND A VEHICLE

FIELD OF THE INVENTION

The present invention relates to a molten metal supplying system, a container, and a vehicle used to supply for example molten aluminum.

BACKGROUND OF THE INVENTION

In a factory where aluminum is molded using many die-casting machines, an aluminum material is often supplied not only from within the factory but also from outside of the factory. In such a case, a container storing aluminum in a melt is carried from a factory on the material supply side to a factory on the molding side to supply to each of the die-casting machines the material kept in the melt.

A conventional container that stores molten metal has a pot-shaped structure of which a supply pipe is disposed on a side wall. When a container is inclined, molten metal is supplied from the pipe to a die-cast side holding furnace.

Japanese Utility Model Registration Laid-Open Publication No H3-31063 discloses a technology of which molten aluminum is supplied by a compression system.

[Patent Literature]JP-UM-A-3-31063

DISCLOSURE OF INVENTION

Problems to be Solved

However, when such a compression type container is used, immediately after the supply of molten aluminum is stopped, the molten aluminum resides in the pipe. Thus, as the container is conveyed to another place, the residual molten aluminum drips from the pipe.

The present invention is made from the foregoing point of view. An object of the present invention is to provide a molten metal supplying system, a container, and a vehicle that prevent molten metal from dripping from a pipe, the molten metal residing in the pipe immediately after the supply of the molten metal is stopped.

Another object of the present invention is to provide a container that allows a reception dish that receives molten metal that dips from an opening of a pipe to be securely conveyed to a proper place at proper timing.

Means for Solving the Problem

To solve the foregoing problem, the present invention is a molten metal supplying system comprising (1) a container having: a portable container main body capable of being hermetically sealed and storing molten metal, that has a passage through which a compressed gas is introduced from an outside, a pipe that has an outlet and supplies the molten metal stored in the container main body to the outside: the outlet downwardly extending, a reception dish that receives the molten metal and that is capable of being placed below the outlet of the pipe, a holding member that has a fulcrum to the pipe and rotatably holds the reception dish, a wire that has a first end and a second end, the first end of which being connected to at least one of the reception dish and the holding member and a pair of channel members disposed at the outer bottom of the container main body in a first direction and (2) a vehicle having a fork that is inserted into the pair of channel members and removed therefrom, a carriage on which the fork is mounted, a lift mechanism that lifts up and down the carriage, and a wire pull and return mechanism that is mounted on the carriage and pulls and returns the wire with the second end thereof.

The present invention is a container, comprising a portable container main body capable of being hermetically sealed and storing molten metal, that has a passage through which a compressed gas is introduced from an outside, a pipe that has an outlet and supplies the molten metal stored in the container main body to the outside: the outlet downwardly extending, a reception dish that receives the molten metal and that is capable of being placed below the outlet of the pipe and a holding member that has a fulcrum to the pipe and rotatably holds the reception dish.

The present invention is a vehicle comprising a fork, a carriage on which the fork is mounted, a lift mechanism that lifts up and down the carriage, a wire pull and return mechanism that is mounted on the carriage and that pulls and returns a wire.

According to the present invention, immediately after the supply of molten metal is stopped, the reception dish is placed below the outlet of the pipe, the reception dish can receive molten metal that flows from the outlet of the pipe. Thus, according to the present invention, immediately after the supply of the molten metal is stopped, the molten metal that resides in the pipe can be prevented from dripping from the pipe.

According to the present invention, the reception dish is rotated and moved through the wire pulled and returned by the wire pull and return mechanism mounted on the vehicle side. Since the container that stores the molten metal is heated at very high temperature, when the mechanism, which rotates and moves the reception dish, is mounted on the container side, the mechanism should stand such high temperature. This is very costly and impractical. In contrast, according to the present invention, since the vehicle side has such a mechanism, the reception dish can be rotated and moved at low cost. In addition, according to the present invention, since the wire pull and return mechanism is mounted on the carriage that lifts up and down as the forklifts up and down, the wire pull and return mechanism lifts up and down as the container lifts up and down. Thus, the reception dish can be rotated and moved through the wire by such a simple mechanism.

The pipe may extend in an outer-peripheral direction of the container main body in a second direction that is different from the first direction, and the wire pull and return mechanism is mounted on the carriage in a third direction that is approximately opposite to the second direction.

Thus, when the operator who rides on the vehicle checks, for example, the outlet of the pipe, the output state of the molten aluminum, and so forth, the wire pull and return mechanism does not block his or her line of sight. In other words, if the wire pull and return mechanism is mounted in the opposite direction on the carriage, when the operator checks for example the outlet of the pipe and so forth, since the wire pull and return mechanism blocks his or her line of sight, the operability deteriorates. In contrast, according to the structure of the present invention, the operability improves. This is an important characteristic of the present invention that deals with high temperature molten metal.

The vehicle may have at least one of a gas compressor and a gas tank that supplies compressed gas to the container main body, and the wire pull and return mechanism may have an air cylinder that is driven by compressed gas supplied from at least one of the gas compressor and the gas tank.

Since the compressed gas of at least one of the gas compressor and the gas tank, which is supplied to the container, is also used for the drive source of the wire pull and return mechanism, the energy efficiency is higher than that of a motor. In addition, the number of parts used in the system can be decreased. Since the system according to the present invention has a reserve tank that stores compressed gas as a pressure source of molten aluminum, an air cylinder can be used without any difficulty.

The vehicle may have means for detecting the position of a drive shaft of the air cylinder and means for controlling the gas supplied from at least one of the gas compressor and the gas tank to the container main body corresponding to the detected position.

When the reception dish is placed below the outlet of the pipe, the supply of a gas from at least one of the gas compressor and the air tank to the container is restricted corresponding to the position of the drive shaft of the air cylinder. Thus, when the reception dish is placed below the outlet of the pipe, molten metal can be securely prevented from flowing from the pipe.

Moreover, when the pipe extends diagonally, not upwardly, a fulcrum member may be mounted to the pipe so that the fulcrum of the holding member is placed just above the outlet of for example the outlet. In this case, when the fulcrum of the holding member is movable on the fulcrum member, the position of the fulcrum of the holding member and the position of the outlet can be easily adjusted.

The reception dish may be rotatably mounted to the holding member. Thus, molten metal can be prevented from dripping from the reception dish.

In addition, it is preferred that the connection position of the wire be as close to the fulcrum of the holding member as possible. Thus, for example, a stoke of the air cylinder can be decreased in size.

Another aspect of the present invention is a container, comprising a portable container main body capable of being hermetically sealed and storing molten metal, that has a passage through which a compressed gas is introduced from an outside, a pipe that has an outlet and supplies the molten metal stored in the container main body to the outside: the outlet downwardly extending, a reception dish that receives the molten metal and that is capable of being placed below the outlet of the pipe, a holding member that has a fulcrum to the pipe and rotatably holds the reception dish between a first position in which the holding member is placed underneath the outlet of the pipe and a second position in which the holding member is retreated from the underneath of the outlet of the pipe, a wire that has a first end and a second end, the first end is connected to at least one of the reception dish and the holding member, a valve that has a first valve opening leading to the passage of the container main body, a second valve opening leading to a pipe for applying and reducing pressure, and a third valve opening leading to an air release portion and that has a first mode in which the gas flows between the first valve opening and the third valve opening and a second mode in which the gas flows between the first valve opening and the second valve opening and an operation lever that is connected to the other end of the wire and to the valve, that is manually rotatable between a first operation position and a second operation position, that causes the valve to be placed in the first mode and the reception dish to be placed in the first position when placed in the first operation position, and that causes the valve to be placed in the second mode and the reception dish to be placed in the second position when placed in the second operation position.

According to the present invention, when the valve operation that selectively connects the inside of the container to the pipe for applying and reducing pressure or the open air is performed by the manual rotation operation of the operation lever, the reception dish is moved between a first position in which the reception dish is placed underneath the outlet of the pipe and a second position in which the reception dish is retreated from the underneath of the outlet of the pipe. Thus, the reception dish can be securely moved to a proper position without intervention of the operator.

It is preferred that the reception dish be rotatably mounted to the holding members. Thus, the reception dish is always maintained in a predetermined posture. As a result, molten aluminum received by the reception dish can be prevented from dripping therefrom.

According to the present invention, a flow restriction portion may be disposed between the third valve opening of the valve and the air release portion, that allows gas to pass to flow, and that restricts the flow of molten metal. It is preferred that the flow restriction portion have a restriction member that removes heat from molten metal that flows so as to increase the viscosity of the molten metal or solidify it. The flow restriction portion releases the increased inner pressure that occurs due to expansion of gas, evaporation of moisture, or the like and can prevent the molten metal from leaking out of the container.

EFFECTS OF THE INVENTION

According to the present invention, since the reception dish can receive molten metal that flows from the outlet of the pipe, the molten metal that resides in the pipe immediately after the supply of the molten metal is stopped does not drip from the pipe. In addition, since the reception dish is rotated and moved by the wire pull and return mechanism mounted on the vehicle side through the wire, the reception dish can be rotated and moved at low cost. Moreover, since the wire pull and return mechanism lifts up and down as the container lifts up and down, the reception dish can be rotated and moved by such a simple structure through the wire.

In addition, according to the present invention, the reception dish that receives molten metal that drips from the outlet of the pipe can be securely moved to a proper place at proper timing without intervention of the operator.

BEST MODE FOR CARRYING OUT THE INVENTION

Hereinafter, embodiments of the present invention will be described with reference to the drawings.

(Structure of Container)

FIG. 1 is a sectional view showing the structure of a container according to an embodiment of the present invention. FIG. 2 is a front view showing the container shown in FIG. 1. FIG. 3 is a plan view showing the container shown in FIG. 1.

The container is denoted by reference numeral 1 has a container main body 2 and a pipe 4. The container main body 2 has a lid 3.

The container main body 2 has a frame body 6, a heat-insulating layer 7, and a refractory layer 8. The frame body 6 is made of metal and formed in a bottomed cylindrical shape. The heat-insulating layer 7 and the refractory layer 8 are made of elastic materials and are disposed on an inner wall of the frame body 6. A storage portion 9 is disposed inside the refractory layer 8. The storage portion 9 stores molten aluminum.

A flange 10 is provided at an outer peripheral of the opening of the frame body 6. A pair of a channel member 11 is attached to the bottom, outside of the frame body 6. A fork of the forklift truck that conveys the container 1 can be inserted into and removed from the channel members 11.

A protruding portion 12 protrudes along an inner wall of the refractory layer 8 in the storage portion 9. The protruding portion 12 is integrated with the refractory layer 8. A flow path 13 that allows molten aluminum to flow to the outside of the container 1 is disposed in the protruding portion 12 along the protruding portion 12. The flow path 13 is formed from a position close to the bottom of the storage portion 9 to the upper surface of the storage portion 9.

A pipe 14 made of for example ceramics is integrally secured to the flow path 13. As a result, when the inside of the storage portion 9 is compressed, gas can be prevented from entering the flow path 13.

The lid 3 is comprised of a large lid 15 and a hatch (a small lid) 16. A flange 16*a* is disposed on the outer periphery of the large lid 15. When the flange 16*a* and the flange 10 disposed on the outer periphery of the frame body 6 are tightened with bolts 17, the lid 3 is secured to the container main body 2. As a result, the inside of the container main body 2 is hermetically sealed.

An opening portion 18 is formed in the large lid 15. The hatch (small lid) 16 is disposed at the opening portion 18. The hatch 16 has a handle 19*a*. The hatch 16 is provided at a position slightly higher than the upper face of the large lid 15. A portion on the outer periphery of the hatch 16 is attached to the large lid 20 through a hinge 20. This allows the hatch 16 to freely open and close the opening 18 in the large lid 15. Handled bolts 21 that secure the hatch 16 to the large lid 15 are disposed at four outer peripheral positions of the hatch 16. When the opening portion 18 of the large lid 15 is closed with the hatch 16 and the handled bolts 21 are turned, the hatch 16 is secured to the large lid 15. On the other hand, by inversely rotating the handled bolts 21 to release the fixation, the hatch 16 can be opened from the opening 18 in the large lid 15. When the hatch 16 is opened, the inside of the container 1 can be maintained and a pre-heat gas burner can be inserted into the container 1 through the opening portion 18.

Further, a passage 19 for internal pressure control for reducing and applying pressure in the container 1 is disposed at a center or a position slightly off from the center of the hatch 16. To the passage 19, a pipe 22 for applying and reducing pressure is connected. The pipe 22 extends upward from the passage 19, bends at a predetermined height, and extends in the horizontal direction. An insertion portion of the pipe 22 that is inserted into the passage 19 is threaded. Likewise, an end portion of the passage 19 is threaded. Thus, the pipe 22 is secured to the passage 19. Liquid surface detection electrodes 23 are inserted into the hatch 21 at four positions at intervals of a predetermined length. The large lid 15 and the hatch 16 are composed of a metal frame and an inner lining (a lamination of a heat-insulating layer and a refractory layer).

An opening 24 is provided at a position corresponding to the flow path 13 of the large lid 15. The outer periphery of the opening 24 protrudes. A flange 25 is disposed at the end of the protruded outer periphery. The flange 25 is tightened to a flange 26 of the pipe 4 with bolts 27. As a result, the pipe 4 is secured to the container main body 2.

The pipe 4 has a first member 28 that upwardly extends from the upper surface of the container main body 2, a second member 29 that is connected to the first member 28 and that extends in the upper right direction from the first member 28, and a third member 30 that is connected to the second member 28 and that downwardly extends from the second member 28. Disposed at an end of the third member 30 is an outlet 31. The outlet 31 downwardly extends and supplies molten aluminum. The pipe 4 extends to the outer periphery of the container main body 2.

When the direction in which the pair of channel members 11 are disposed is referred to as the first direction and the direction in which the pipe 4 extends is referred to as the second direction, the angle between the first direction and the second direction is around 45°. When the fork of the forklift truck is inserted into the channel members 11, the operator who rides on the forklift truck can see the pipe 4 that extends sideward rather than forwardly from a lift mechanism of the forklift truck. Thus, the operator can check the state of the outlet 31 and so forth of the pipe 4 without blockage of his or her line of sight.

Molten aluminum may be supplied from the outside to the container main body 2 through the outlet 31 and the pipe 4. In this case, the outlet 31 is placed below the level of molten aluminum of an external storage tank and the pressure inside of the container main body 2 is reduced. The height of the outlet 31 may be designated depending on the level of molten aluminum of the external storage tank. For example, according to this embodiment, the length of the third member 30 of the pipe 4 is designated so that the outlet 31 is placed in approximately the middle position of the container main body 2.

A reception dish 40 is disposed so that it can be placed below the outlet 31 of the pipe 4. The reception dish 40 is rotatably held by holding members 42 that have a fulcrum 41 at for example an upper portion of the third member 30 of the pipe 4.

Two holding members 42 are disposed on both sides of the pipe 4 so that the holding members 42 sandwich the pipe 4. The reception dish 40 may be rotatably mounted on the holding member 42. Thus, the reception dish 40 always keeps a predetermined posture so that molten aluminum does not drip from the reception dish 40.

Since the reception dish 40 has a receiving surface with a predetermined curvature, molten aluminum is prevented from dripping from the reception dish 40. The two holding members 42 are connected by semi-ring shaped stopper members 43 disposed at for example two positions of the holding members 42. The stopper members 43 are disposed so that they cross the rotation sides of the holding members 42 of the pipe 4. The stopper members 43 securely position the reception dish 40 below the outlet 31 of the pipe 4.

A wire 44 is connected at a predetermined position of the holding member 42. The wire 44 extends to the outside of the outer periphery of the container main body 2 through guide members disposed at for example three positions on the flange 16*a* of the large lid 15 in a third direction approximately opposite to the direction in which the pipe 4 extends. It is preferred that the wire 44 be connected to a position as close to the fulcrum 41 of the holding member 42 as possible. In this case, the stroke of an air cylinder, that will be described later, can be decreased. However, the wire 44 may be connected to a position far from the fulcrum 41 of the holding member 42. For example, the wire 44 may be connected to the reception dish 40.

(Structure of Forklift Truck)

FIG. 4 is a plan view showing the structure of a forklift truck (vehicle) according to an embodiment of the present invention. FIG. 5 is a front view showing the structure of the forklift truck shown in FIG. 4.

A forklift truck 50 has a fork 51, a carriage 52, and a lift mechanism 53. The fork 51 is mounted on the carriage 52. The lift mechanism 53 lifts up and down the carriage 52.

Disposed above a driver seat 54 of the forklift truck 50 are a reserve tank 55, an air compressor 56, and a vacuum pump 57. The reserve tank 55 is a compressed gas storage tank that supplies compressed gas for example compressed air to the container 1. The air compressor 56 is driven by electric power generated by an electric power generator (not shown). The vacuum pump 57 is driven by the electric power generator.

The reserve tank 55 and the vacuum pump 57 are connected to the pipe 22 of the container 1 through an air hose 58. The air hose 58 and the pipe 22 have a plug and a socket as coupler members that are connectable and disconnectable. The inside of the container 1 can be applied with pressure and decreased with pressure by a switching valve (not shown) controlled by a handy operation panel(not shown). The wire 44 can be divided by a joint 44*b* so that one forklift truck can handle a plurality of containers 1. In addition to the structure of which the air hose 58 can be connected and disconnected, one forklift truck 50 can switchably handle a plurality of containers 1. According to the present invention, when the number of containers 1 is larger than the number of forklift trucks 50 as in a factory that has a plurality of die-cast machines, the productivity can be improved.

A wire pull and return mechanism 59 that pulls and returns the wire 44 is disposed at a column in the third direction nearly opposite to the direction in which the pipe 4 of the carriage 52 extends.

The wire pull and return mechanism 59 has an air cylinder 60 that is driven by compressed gas supplied from for example the reserve tank 55. The wire 44 can be detachably connected to an end of a drive shaft 61 of the air cylinder 60. When the drive shaft 61 is moved up and down, the wire 44 is pulled or returned.

When the wire 44 is pulled, as shown in FIG. 2 (A), the holding members 42 are rotated toward the container main body 2 around the fulcrum 41. Thus, the position of the reception dish 40 departs from the outlet 31 of the pipe 4. In this state, molten aluminum can be supplied from the outlet 31 of the pipe 4 to the outside. In addition, molten aluminum can be supplied from the outside to the container 1 through the outlet 31 of the pipe 4.

When the wire 44 is returned, the holding members 42 are rotated from the container main body 2 to the outlet 31 of the pipe 4 around the fulcrum 41. Thus, as shown in FIG. 2 (B), the reception dish 40 is placed below the outlet 31 of the pipe 4. In this state, the reception dish 40 can receive molten aluminum that drips from the outlet 31 of the pipe 4. As a result, molten aluminum does not drip from the outlet 31 of the pipe 4 to the outside.

The moving operation of the reception dish 40 can be performed by a switch on the handy operation panel (not shown).

The wire pull and return mechanism 59 has a detector (not shown) that detects the position of the drive shaft 61 of the air cylinder 60. The position of the drive shaft 61 may be detected by for example a solenoid switch. When the position of the drive shaft 61 represents that the reception dish 40 is below the outlet 31 of the pipe 4, the reserve tank 55 and the vacuum pump 57 are prohibited from applying and reducing the pressure inside the container 1. In contrast, when the position of the drive shaft 61 represents that the reception dish 40 is not below the outlet 31 of the pipe 4, the reserve tank 55 and the vacuum pump 57 are allowed to apply and reduce pressure inside the container 1. To accomplish this operation, for example an on/off solenoid value is disposed between the reserve tank 55 and the vacuum pump 57 on the forklift truck side and the air hose 58. The on/off solenoid valve is interlocked with the moving operation switch for the reception dish 40.

Other Embodiment 1

In the foregoing embodiment, the fulcrum 41 is disposed at the predetermined position of the holding members 42. However, as shown in FIG. 6, when the third member 30 of the pipe 4 extends downwardly with an angle, not straightly, a fulcrum member 61*a* is mounted to the pipe 4. The fulcrum member 61*a* may be adjusted so that the fulcrum 41 of the holding members 42 is placed just above the outlet 31. In this case, when the fulcrum 41 of the holding members 42 is horizontally movable on the fulcrum member 61*a*, the position of the fulcrum 41 of the holding members 42 and the position of the outlet 31 can be easily adjusted.

In the foregoing embodiment, the wire pull and return mechanism 59 is disposed at the column that extends in the third direction approximately opposite to the direction in which the pipe 4 of the carriage 52 extends. However, as shown in FIG. 7, the wire pull and return mechanism 59 may be disposed at a column that extends in the same direction as the pipe 4 of the carriage 52. In this case, since the length of the wire 44 decreases, the operability improves. The air cylinder may be disposed sideways on the upper surface of the carriage, not the side surface of the carriage.

According to the foregoing embodiment, an air cylinder is used as a drive source of the wire pull and return mechanism 59. Instead, another drive means such as a motor may be used.

Other Embodiment 2

FIG. 8 is a sectional view showing the structure of a molten metal supplying container according to an embodiment of the present invention. FIG. 9 is a front view showing the structure of the molten metal supplying container shown in FIG. 8. FIG. 10 is a plan view showing the structure of the molten metal supplying container shown in FIG. 8.

A container for supplying molten metal (hereinafter referred to as the container) 101 has a container main body 102 and a pipe 104. The container main body 102 has a lid 103.

The container main body 102 has a frame body 106, a heat-insulating layer 107, and a refractory layer 108. The frame body 106 is made of metal and formed in a bottomed cylindrical shape. The heat-insulating layer 107 and the refractory layer 108 are made of elastic materials and are disposed on an inner wall of the frame body 106. A storage portion 109 is disposed inside the refractory layer 108. The storage portion 109 stores molten aluminum. A flange 110 is disposed on the outer periphery of the opening of the frame body 106. Two channel members 111 that are leg portions that have a sectional shape and a predetermined length are disposed for example in parallel at the outer bottom of the frame body 106 so that for example a fork (not shown) of the forklift truck can be inserted into and removed from the channel members 111.

A protruding portion 112 protrudes along an inner wall of the refractory layer 8 in the storage portion 109. The protruding portion 12 is integrated with the refractory layer 108. A flow path 113 that allows molten aluminum to flow to the outside of the container 1 is disposed in the protruding portion 112 along the protruding portion 112. The flow path 113 is formed from a position close to the bottom of the storage portion 109 to the upper surface of the storage portion 109.

A pipe 114 made of, for example, ceramics is integrally secured to the flow path 113. As a result, when the inside of the storage portion 109 is applied with pressure, gas can be prevented from entering the flow path 113.

A lid 103 is comprised of a large lid 115 and a hatch (a small lid) 116. A flange 16*a* is disposed on the outer periphery of the large lid 115. When the flange 16*a* and the flange 110 disposed on the outer periphery of the frame body 106 are tightened with bolts 117, the lid 103 is secured to the container main body 102. As a result, the inside of the container main body 2 is hermetically sealed.

An opening portion 118 is formed in the large lid 115. The hatch (small lid) 116 is disposed at the opening portion 118. The hatch 16 has a handle 119*a*.The hatch 116 is provided at a position slightly higher than the upper face of the large lid 115. A portion on the outer periphery of the hatch 116 is attached to the large lid 115 through a hinge 120. This allows the hatch 116 to freely open and close the opening 118 in the large lid 115. Handled bolts 121 that secure the hatch 116 to the large lid 115 are disposed at two positions of the hatch 116. When the opening portion 118 of the large lid 115 is closed with the hatch 116 and the handled bolts 121 are turned, the hatch 116 is secured to the large lid 115. On the other hand, by inversely rotating the bolt 121 with the handle to release the fixation, the hatch 116 can be opened from the opening 118 of the large lid 115. When the hatch 116 is opened, the inside of the container 101 can be maintained and a pre-heat gas burner can be inserted into the container 101 through the opening portion 118.

Disposed at the center position or a near-center position of the hatch 116 is a passage 119 through which the internal pressure of the container 101 is controlled. One end to the passage 119 is connected to the storage portion 109. The other end of the passage 119 reaches the upper surface of the hatch 116 and is connected to a pipe 122 for applying and reducing pressure through a three-way valve 160.

The pipe 122 for applying and reducing pressure is composed of a lower pipe 122B and an upper pipe 122A. The lower pipe 122B is directly connected to the three-way pipe 160. The upper pipe 122A is connected to the lower pipe 122B through a swivel joint 146. The swivel joint 146 allows the upper pipe 122A to rotate by 360 degrees. Thus, the opening at an end of the upper pipe 122A can be turned by 360 degrees.

Liquid surface detection electrodes 123 are inserted into the hatch 116 at two positions at intervals of a predetermined length. The large lid 115 and the hatch 116 are composed of a metal frame and an inner lining (a lamination of a heat-insulating layer and a refractory layer).

An opening 124 is formed in the large lid 115 corresponding to the flow path 113. The pipe 104 is connected to the opening 124. More specifically, the outer periphery of the opening 124 protrudes. A flange 125 is disposed at the end of the protruded outer periphery. The flange 125 is tightened to a flange 126 of the pipe 104 with bolts 127.

The pipe 104 has a first member 128 that upwardly extends from the upper surface of the container main body 102, a second member 129 that is connected to the first member 128 and that extends in the upper right direction from the first member 128, and a third member 130 that is connected to the second member 128 and that downwardly extends from the second member 128. Disposed at an end of the third member 130 is an outlet 131. The outlet 31 downwardly extends and supplies molten aluminum. The pipe 104 extends to the outer periphery of the container main body 102.

When the direction in which the pair of channel members 111 are disposed is referred to as the first direction and the direction in which the pipe 104 extends is referred to as the second direction, the angle between the first direction and the second direction is around 45°. When the fork of the forklift truck is inserted into the channel members 111, the operator who rides on the forklift truck can see the pipe 104 that extends sideward rather than forwardly from a lift mechanism of the fork lift truck. Thus, the operator can check the state of the outlet 131 and so forth of the pipe 104 without blockage of his or her line of sight.

Molten aluminum may be supplied from the outside to the container main body 102 through the outlet 131 and the pipe 104. In this case, the outlet 131 is placed below the level of molten aluminum of an external storage tank and the pressure inside of the container main body 102 is reduced. The height of the outlet 131 may be designated depending on the level of molten aluminum of the external storage tank. For example, according to this embodiment, the length of the third member 130 of the pipe 104 is designated so that the outlet 131 is placed in approximately the middle position of the container main body 102.

A reception dish 140 is disposed so that it can be placed below the outlet 131 of the pipe 104. The reception dish 140 is held at the lower end of holding members 142 that have a fulcrum 141 at for example an upper portion of the third member 130 of the pipe 104.

Two holding members 142 are disposed on both sides of the pipe 104 so that the holding members 42 sandwich the pipe 104. The reception dish 140 may be rotatably mounted on the holding member 142. Thus, the reception dish 140 always keeps a predetermined posture so that molten aluminum does not drip from the reception dish 140.

Since the reception dish 140 has a receiving surface with a predetermined curvature, molten aluminum is prevented from dripping from the reception dish 140. The two holding members 142 are connected by semi-ring shaped stopper members 143 disposed at for example two positions. The stopper members 143 are disposed so that they cross the rotation sides of the holding members 142 of the pipe 104. The stopper members 143 securely position the reception dish 140 below the outlet 131 of the pipe 104.

The holding member 142 is rotatably held by the fulcrum 141 secured at for example the upper portion of the third portion 130 of the pipe 104. Specifically, a movable range of the holding member 142 is designated so that the reception dish 140 moves between a first position in which the reception dish 140 is placed underneath the outlet 131 of the pipe 104 and a second position in which the reception dish 140 is retreated from the underneath of the outlet 131. A wire 144 is connected at a predetermined position of the holding member 142. The wire 144 is connected to an operation lever 166 of the three-way valve 160 through a guide member 145 disposed at the connecting portion of the first member 128 and the second member 129. In other words, the rotation of the operation lever 166 of the three-way valve 160 is interlocked with the rotation of the holding member 142.

Next, the three-way valve 160 will be described in detail.

FIG. 11 and FIG. 12 show the structure of the three-way valve 160.

The three-way valve 160 has a first valve opening 162 that leads to an inner pressure adjustment passage 119 of the container 101, a second valve opening 163 that leads to a pipe 122 for applying and reducing pressure, and a third valve opening 164 that leads to an air release portion. The three-way valve 160 has a valve member 165 that is manually rotated by the operation lever 166. As shown in FIG. 11, depending on the position of the valve member 165, a first mode in which gas flows between the first valve opening 162 and the third valve opening 164 or a second mode in which gas flows between the first valve opening 162 and the second valve opening 163 is selected. In this example, as shown in FIG. 11, when the operation lever 166 is placed in a first operation position, "0 o'clock", the first mode is selected and the inside of the container 101 is exposed to outer air. As shown in FIG. 12, when the operation lever 166 is placed in a second operation position, "9 o'clock", the second mode is selected and the inside of the container 101 is connected to the pipe 122 for applying and reducing pressure.

The rotation range of the operation lever 166 is restricted so that the operation lever 166 is rotated only between the first operation position and the second operation position. The operation lever 166 can be placed in these operation positions.

The operation lever 166 is rotatable about a rotation shaft 167 as a fulcrum of the valve member 165 of the three-way valve 160. The direction of the rotation operation of the operation lever 166 is designated so that as the operation lever 166 is rotated, an end of the operation lever 166 is linearly advanced and retreated to/from the pipe 104. A weight 168 and a wire fastener 169 that secures the end of the wire 144 are disposed at a near-end portion of the operation lever 166.

The end of the wire 144 is secured to the near-end portion of the operation lever 166. When the operation lever 166 is rotated between the first operation position and the second operation position, the holding members 142 that hold the reception dish 140 are rotated around the fulcrum 141 and the reception dish 140 is moved between the first position in which the reception dish 140 is placed underneath the outlet 131 of the pipe 104 and the second position in which the reception dish 140 is retreated from the underneath of the outlet 131.

When the operation lever 166 is placed in the second operation position, "9 o'clock" position, the pipe 122 for applying and reducing pressure and the inside of the container 101 are connected. In addition, since the wire 144 is pulled, the holding members 142 are rotated to the container 101 side so that the reception dish 140 is retreated from the underneath of the outlet 131 of the pipe 104 and moved to the second position. Thus, in this state, molten aluminum can be supplied from the outlet 131 of the pipe 104 or supplied to the container 101.

When the operation lever 166 is rotated from the "9 o'clock" position to the "0 o'clock" position as the first operation position, the inside of the container 101 is exposed to outer air. In addition, the wire 144 is pulled toward the pipe 104 due to the weight of the holding members 142. The holding members 142 are rotated so that the reception dish 140 is placed below the outlet 131 of the pipe 104. Thus, in this state, when the inner pressure of the container 101 increases because, for example, gas expands or moisture evaporates in the container 101, the pressure can be released to the outside through the three-way valve 160. As a result, molten aluminum can be prevented from being suddenly supplied from the pipe 104 of the container 101. In addition, the reception dish 140 can receive molten aluminum that drips from the outlet 131 of the pipe 104.

The container 101 with such configuration, for example is supplied with molten aluminum in a first factory where, for example, molten metal is adjusted in a melting furnace. The container 101 is then transferred to a truck by a forklift truck. The truck transfers the container 101 to a second factory that has a use point for the molten aluminum (for example, a holding furnace for a die-cast machine). At this point, when the operation lever 166 is placed in the "0 o'clock" position as the first operation position, molten aluminum can be prevented from being supplied from the pipe 104 of the container 101 due to an increase of the inner pressure during transportation. The reception dish 140 can receive molten aluminum that drips from the outlet 131 of the pipe 104. The container 101 is unloaded from the truck by a forklift truck. The forklift truck conveys the container 101 to the use point. After the container 101 has arrived at the use point, the operation lever 166 is rotated to the second operation position, namely the "9 o'clock" position. External compressed air is supplied to the container 101 through the pipe 122 for applying and reducing pressure. As a result, the molten aluminum is supplied from the container 101 on the forklift truck to the use point.

FIG. 13 is a side view showing the structure of the forklift truck used to supply molten aluminum from the container 101 shown in FIG. 8.

A forklift truck 150 has a fork 151, a carriage 152, and a lift mechanism 153. The fork 151 is mounted on the carriage 152. The lift mechanism 153 lifts up and down the carriage 152.

Disposed above a driver seat 154 of the forklift truck 150 are a reserve tank 155, an air compressor 156, and a vacuum pump 157. The reserve tank 155 is a compressed gas storage tank that supplies compressed gas, for example, compressed air to the container 101. The air compressor 156 is driven by electric power generated by an electric power generator (not shown). The vacuum pump 157 is driven by the electric power generator. The reserve tank 155 and the vacuum pump 157 are connected to the pipe 122 of the container 101 through an air hose 158. The air hose 158 and the pipe 122 have a plug and a socket as coupler members that are connectable and disconnectable. The inside of the container 101 can be applied with pressure and decreased with pressure by a switching valve controlled by a handy operation panel (not shown).

When the engine of the forklift truck 150 is started, the electric power generator is started. Electric power generated by the electric power generator operates the air compressor 156 compresses air. When molten aluminum is supplied from the container 101 to the outside, the inside of the container 101 is applied with pressure. In this case, gas supplied from the air compressor 156 reaches the air hose 158 and the pipe 122 of the container 101. In this case, when the operation lever 166 of the three-way valve 160 is placed in the "9 o'clock position" as the second operation position, the three-way valve 160 is placed in the second mode. As a result, gas is supplied from the pipe 122 for applying and reducing pressure to the container 101. Thus, the inside of the container 101 is applied with pressure.

In case of emergency, for example, when molten aluminum is flowing from the reception side, it is necessary to stop compressing the inside of the container 101 and stop the supply of the molten aluminum. In this case, the operation lever 166 is manually rotated to the "0 o'clock" position as the first operation position so that the three-way valve 160 is placed in the first mode. When the three-way valve 160 is placed in the first mode, since the second valve opening 163 that leads to the pipe 122 for applying and reducing pressure is closed with a valve member 165, the supply of compressed gas to the container 101 is stopped. In the same time, since gas becomes able to flow between the first valve opening 162, which leads to a passage 119 for controlling inner pressure of the container 101, and the third valve opening 164, which leads to the air release portion, the container 101 is exposed to outer air. Thus, the compressed state of inside of the container 101 is restored to the atmospheric pressure.

When molten aluminum is supplied from the outside to the container 101, the pressure inside the container 101 is reduced. In other words, since the vacuum pump 157 sucks gas from the container 101 through the pipe 122 for applying and reducing pressure and releases the gas to the outside, the pressure inside of the container 101 is reduced. If an emergency situation occurs while the inside of the container 101 is being decompressed, likewise, the operation lever 166 is manually rotated to the "0 o'clock" position as the first operation position so that the three-way valve 160 is placed in the first mode.

According to the foregoing embodiment, since the operation of the three-way valve 160, which selectively connects the inside of the container 101 to the pipe 122 for applying and reducing pressure or outer air, namely manual operation of the operation lever 166 is interlocked with the moving operation of the reception dish 140 between the first position in which the reception dish 140 is placed below the outlet 131 of the pipe 104 and the second position in which the reception dish 140 departs from the outlet 131, the reception dish 140 can be securely moved to a proper position at proper timing without intervention of the operator.

Other Embodiment 3

Next, another embodiment of the present invention will be described.

FIG. 14 is a schematic diagram showing the structure of peripheral sections of the three-way valve 160 according to another embodiment of the present invention. A breather 170 that is a flow restriction portion is disposed in front of the third valve opening 164, which leads to outer air, of the three-way valve 160.

The breather 170 is composed of a breather main body 171, a steel scrubber 172, and punched metal 173. The breather main body 171 contains the steel scrubber 172 as a restriction member. The punched metal 173 is a lid that closes the breather main body 171. Reference numeral 174 is a stop ring that secures the punched metal 173. The restriction member is selected or structured so that it has selectivity that allows for example air to pass and molten aluminum not to pass. When, for example, molten metal flows in the breather main body 171, it removes heat from the molten metal so as to increase the viscosity of the molten metal or solidify it. Besides steel scrubber, the restriction member may be steel wool, ceramic fiber, sintered metal mold, unglazed pottery, or orificed metal member. Such restriction member-functions as safety means for passing gas and restricting passage of molten metal.

Thus, molten metal can be prevented from being suddenly supplied from the pipe 104 of the container 101. In other words, even if the inner pressure of the container 101 increases because gas expands or moisture evaporates, the pressure can be released to the outside of the container 101. Thus, molten metal can be prevented from being suddenly pressurized and leaked out. In addition, even if the container 101 falls down, molten metal can be prevented from flowing from the passage having the regulation member. This is because the restriction member made of, for example, sintered metal or a mold of ceramic fiber allows gas to pass, but causes molten metal such as molten aluminum alloy to solidify, preventing the molten metal from flowing out.

EXPLANATION OF CODES

Figure 1:
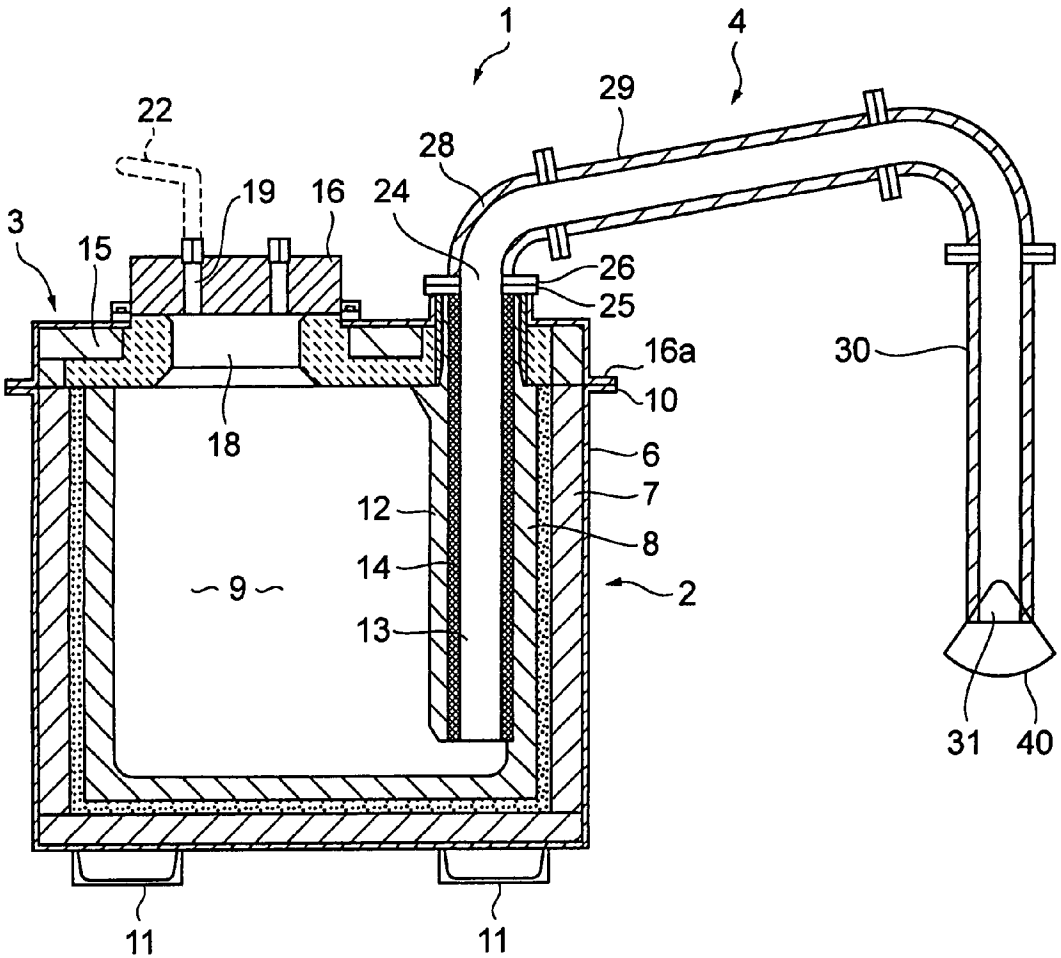
FIG. 1 is a sectional view showing the structure of a container according to an embodiment of the present invention.
Figure 2:
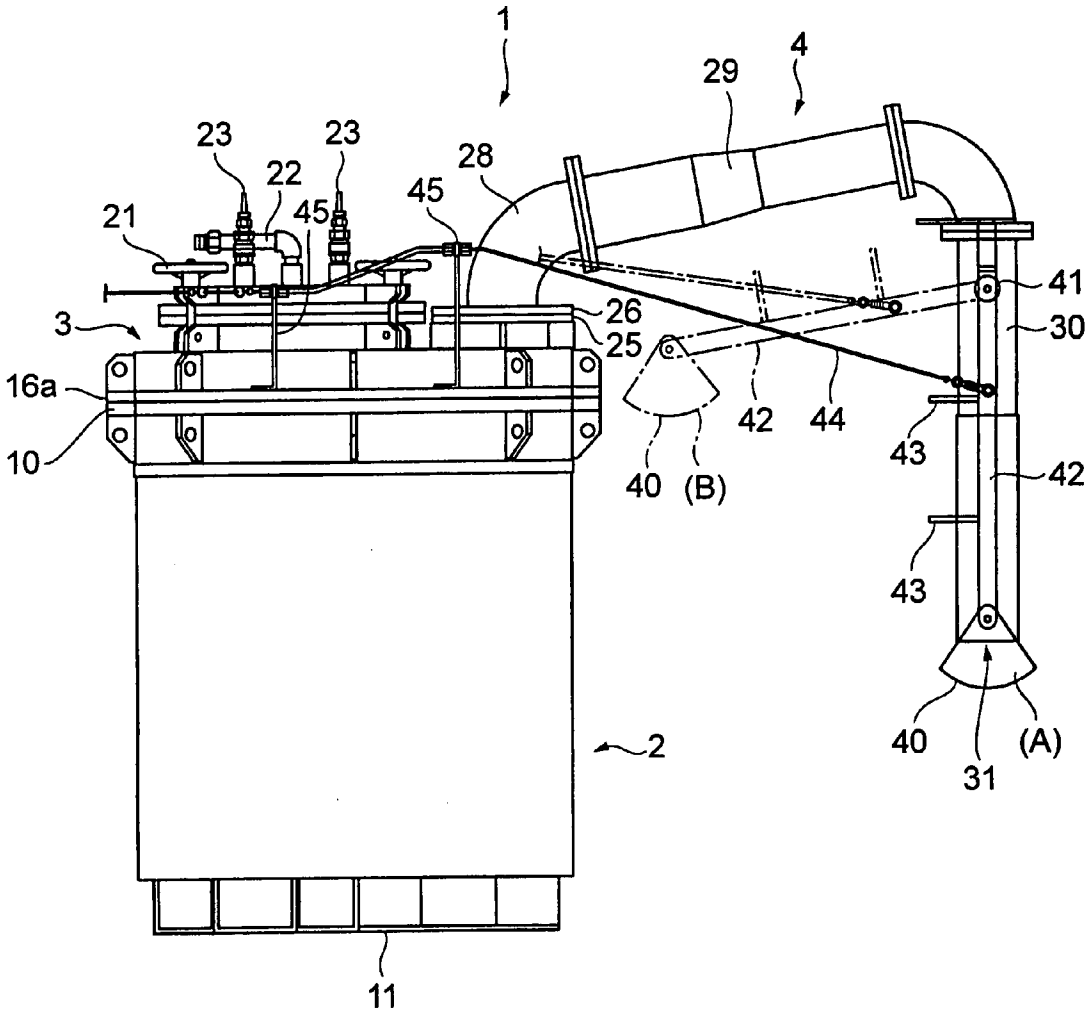
FIG. 2 is a front view showing the structure of the container shown in FIG. 1.
Figure 3:
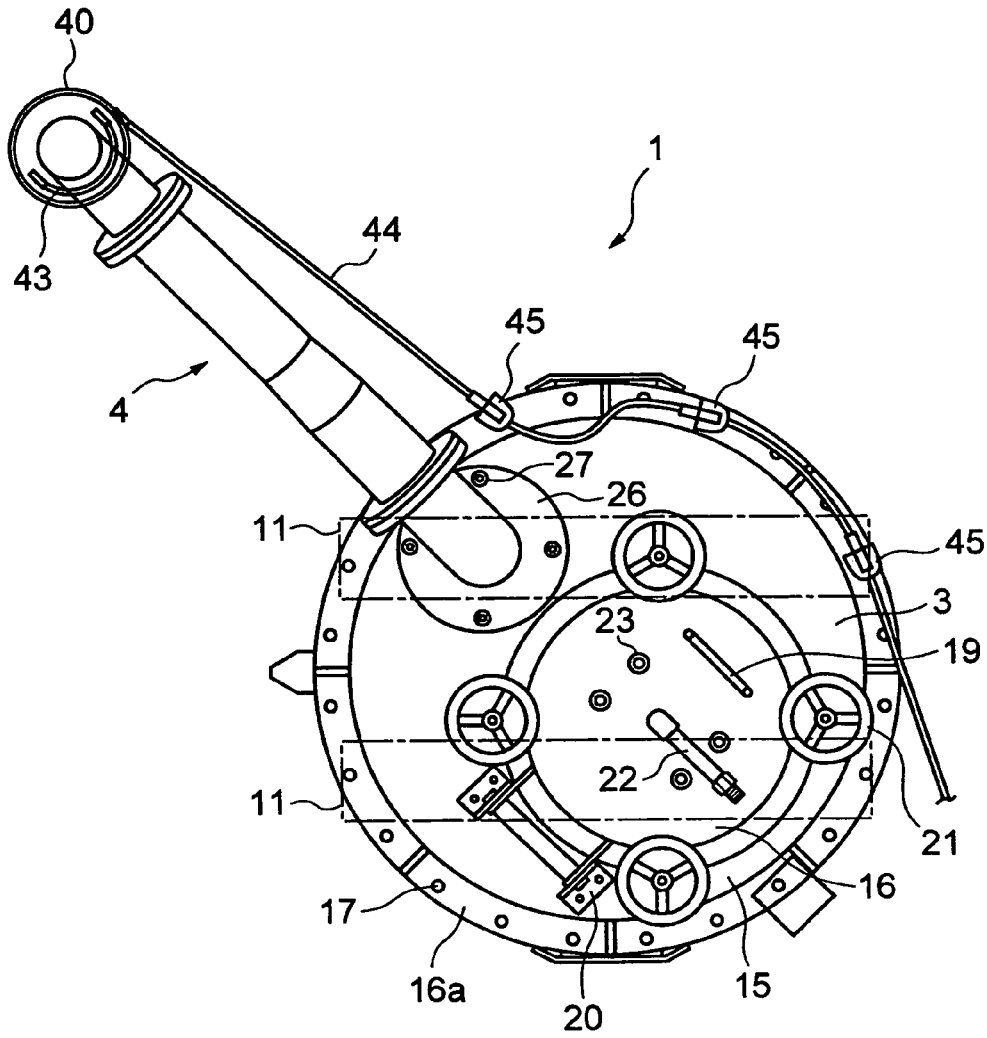
FIG. 3 is a plan view showing the structure of the container shown in FIG. 1.
Figure 4:
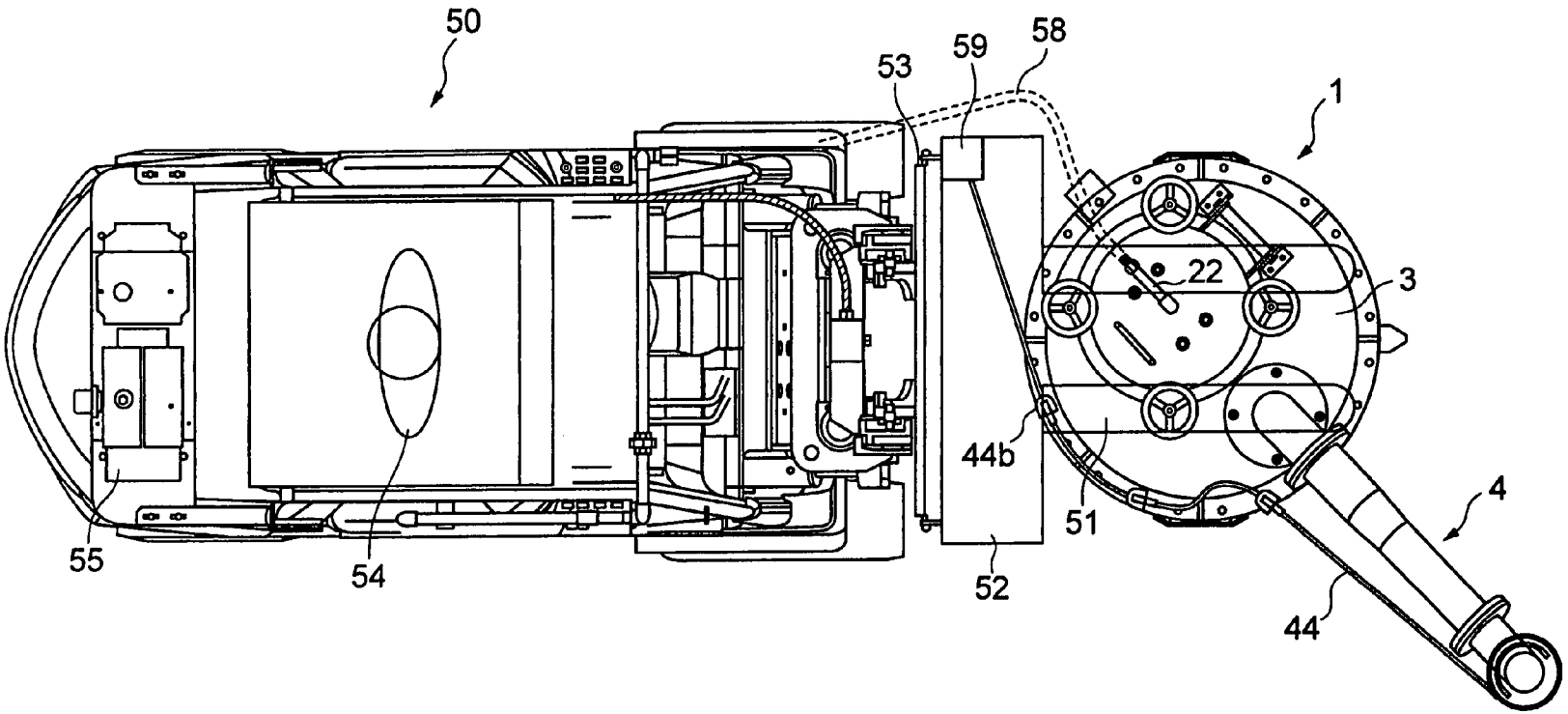
FIG. 4 is a plan view showing the structure of a forklift truck (vehicle) according to the embodiment of the present invention.
Figure 5:
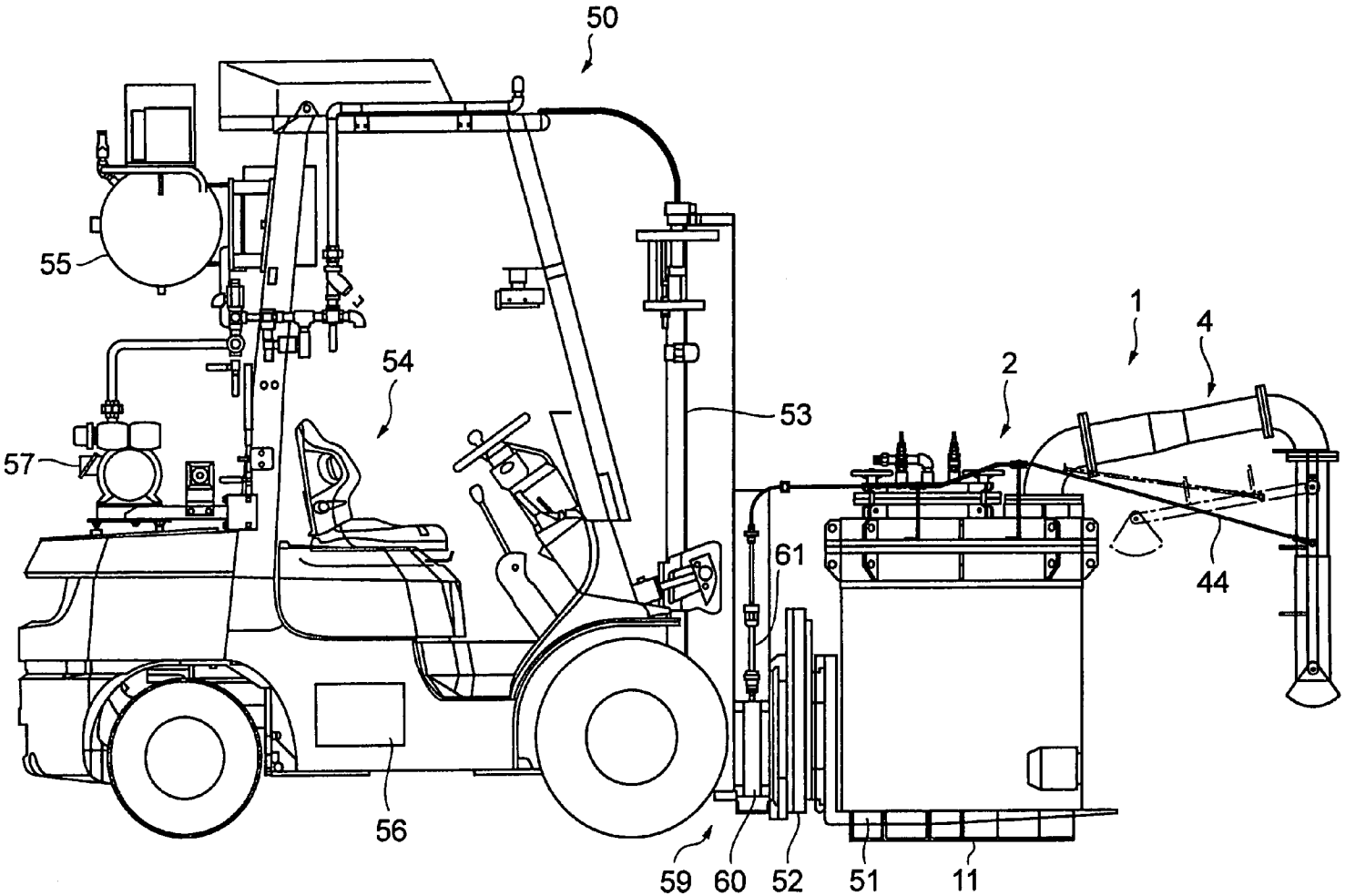
FIG. 5 is a front view showing the structure of the forklift truck shown in FIG. 4.
Figure 6:
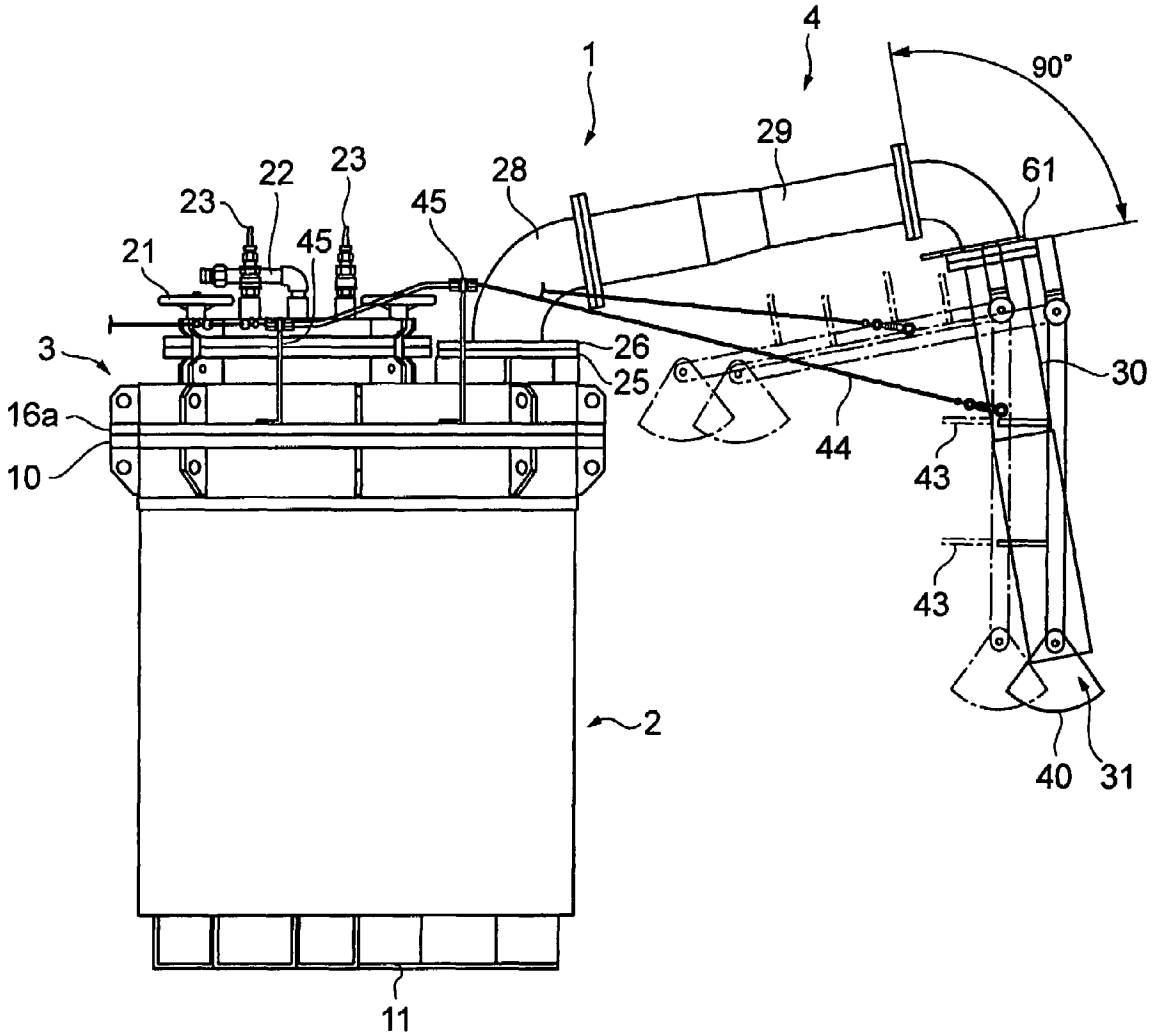
FIG. 6 is a front view showing the structure of a container according to another embodiment of the present invention.
Figure 7:
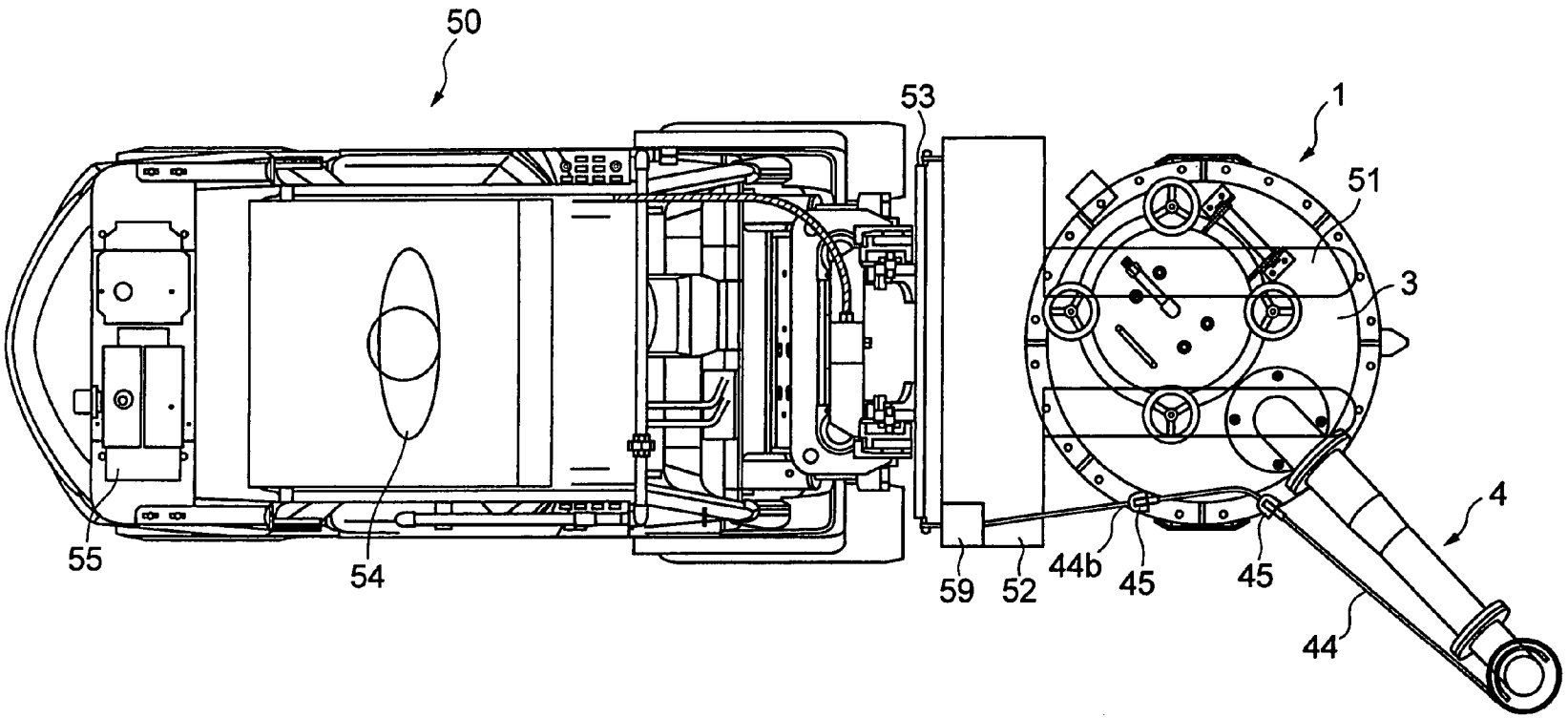
FIG. 7 is a plan view showing the structure of a container according to another embodiment of the present invention.
Figure 8:
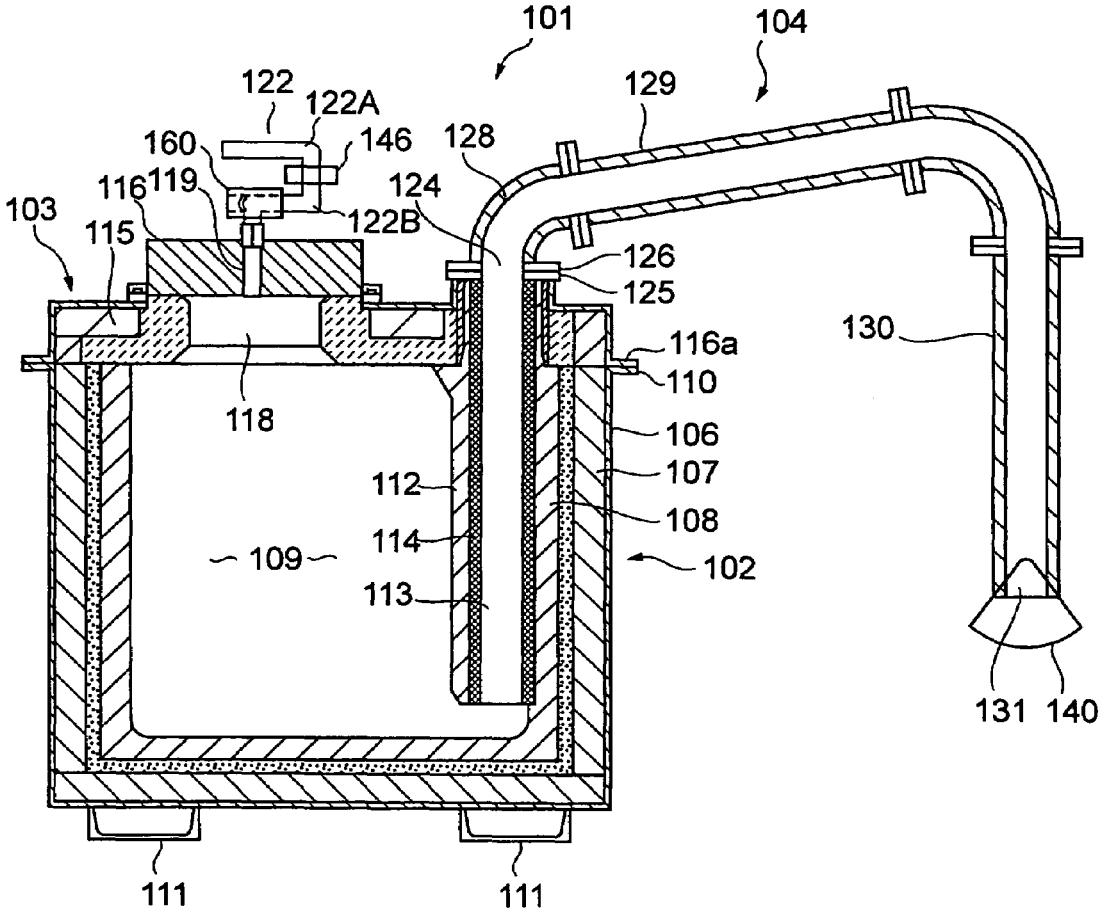
FIG. 8 is a sectional view showing the structure of a molten metal supplying container according to the other embodiment of the present invention.
Figure 9:
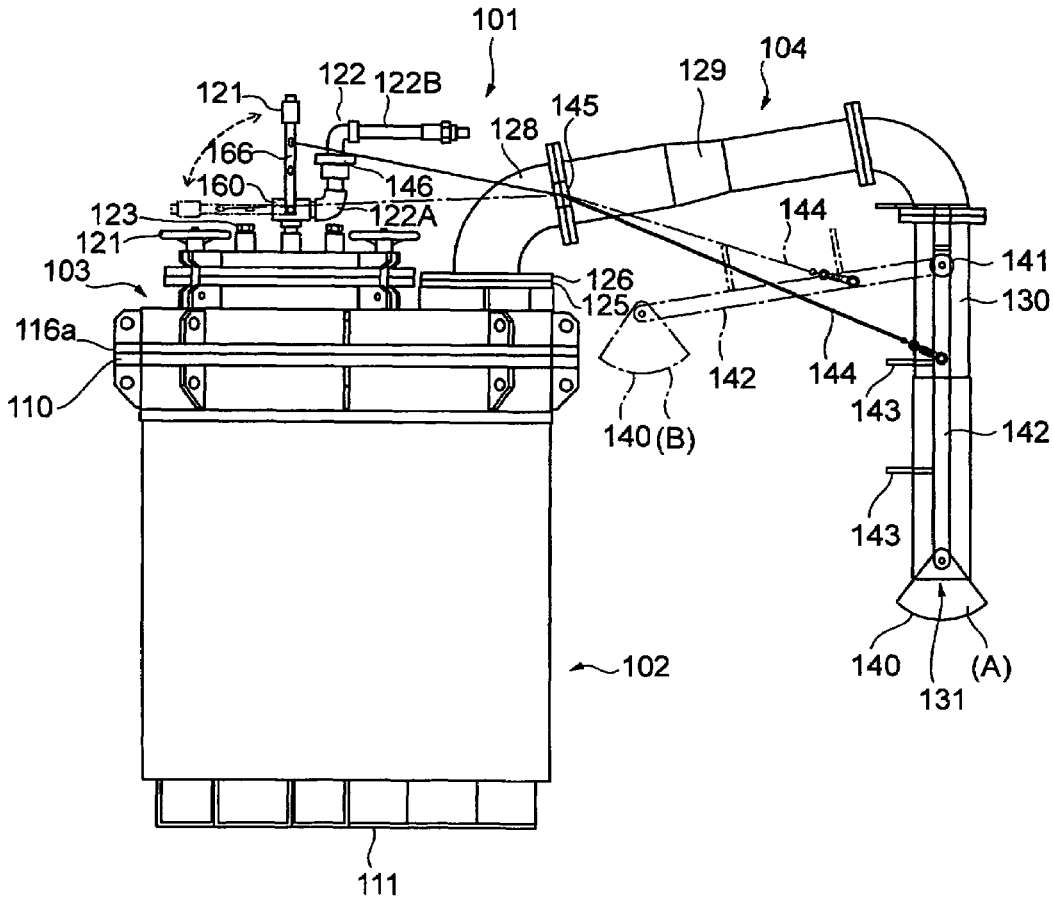
FIG. 9 is a front view showing the structure of the container shown in FIG. 8.
Figure 10:
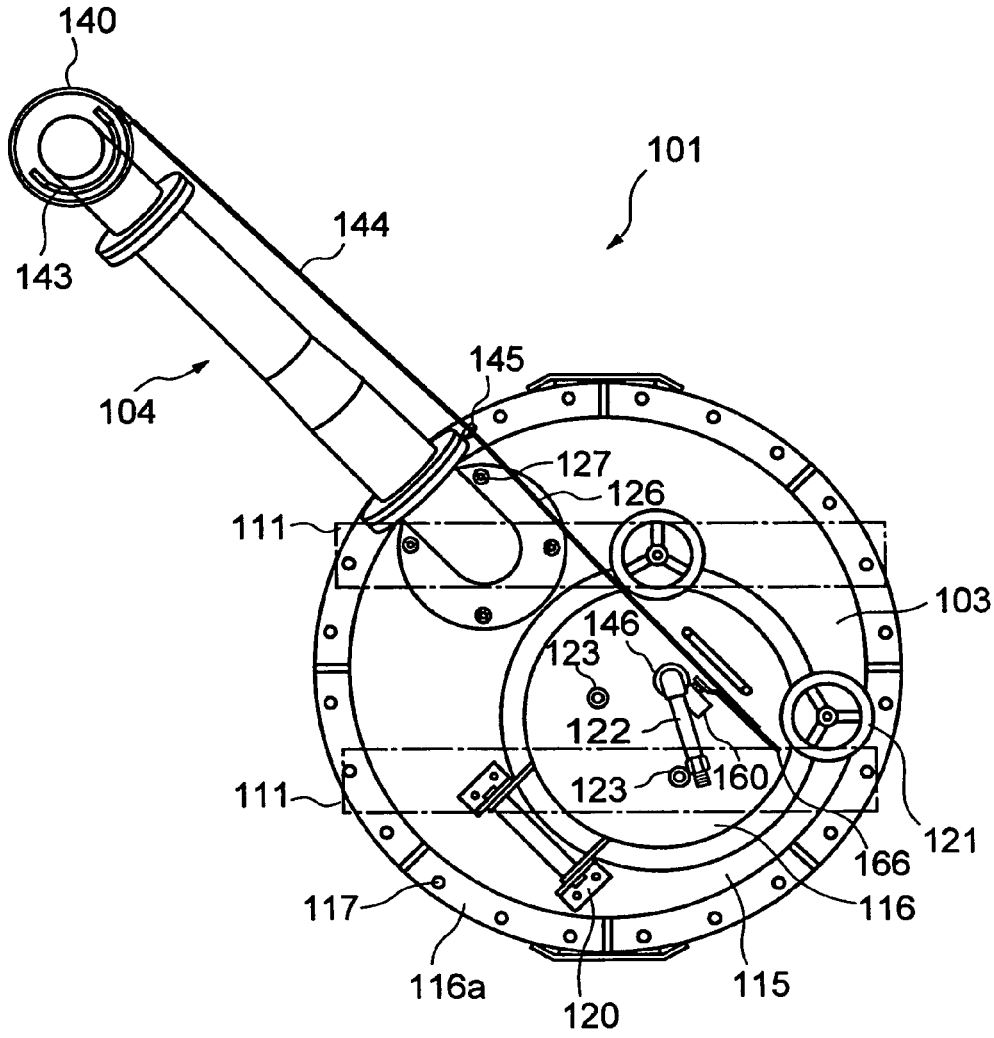
FIG. 10 is a plan view showing the structure of the container shown in FIG. 8.
Figure 11:
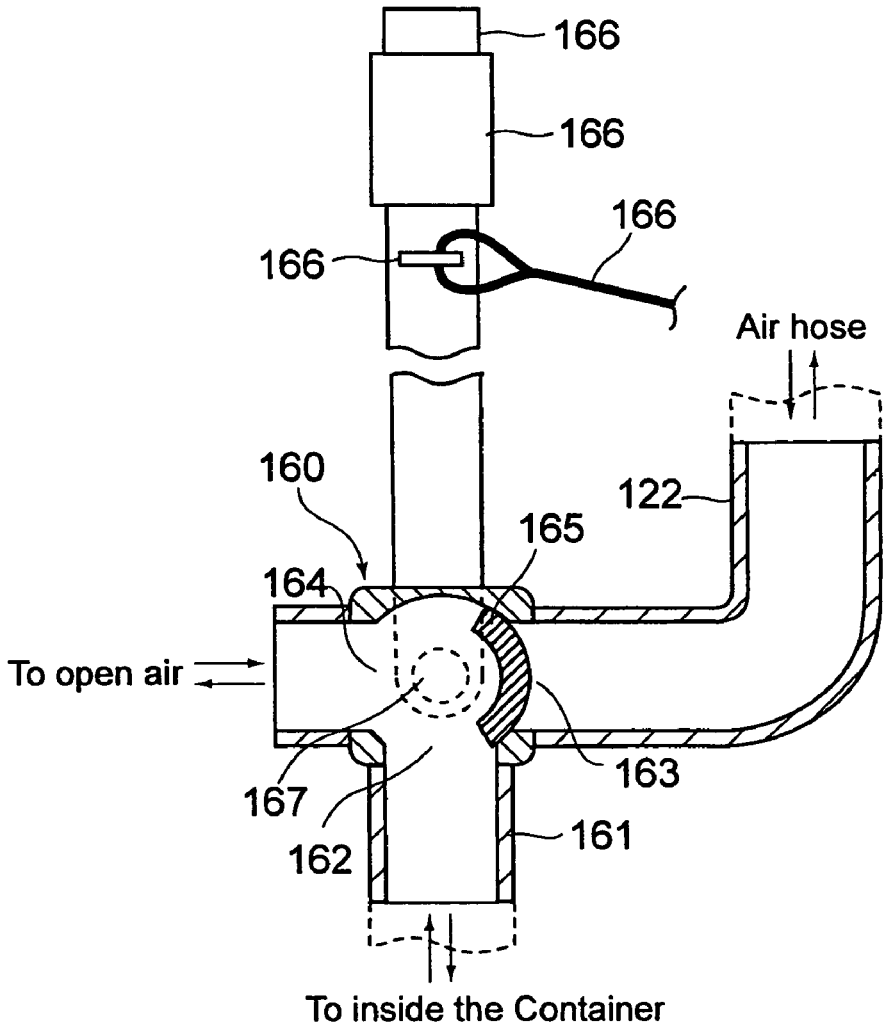
FIG. 11 is a schematic diagram showing the state of a first mode of a three-way valve shown in FIG. 8.
Figure 12:
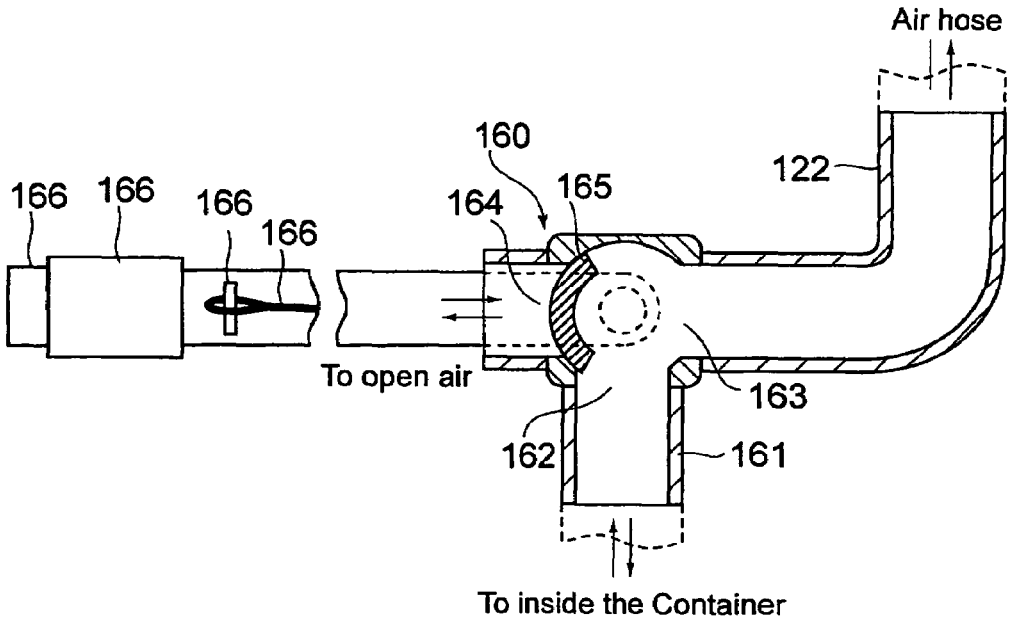
FIG. 12 is a schematic diagram showing the state of a second mode of the three-way valve shown in FIG. 8.
Figure 13:
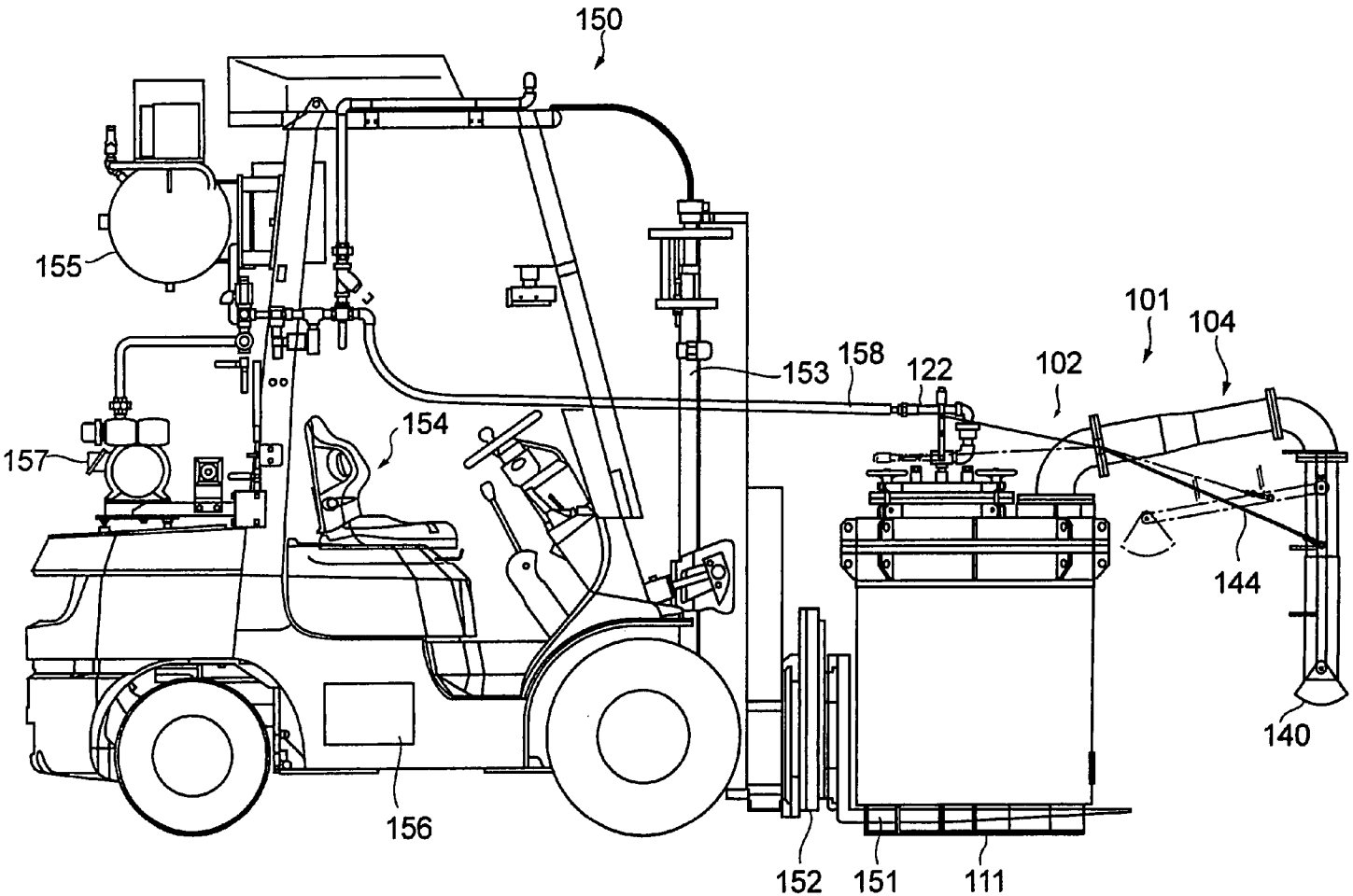
FIG. 13 is a side view showing the structure of a forklift truck used when molten aluminum is supplied from the container shown in FIG. 8.
Figure 14:
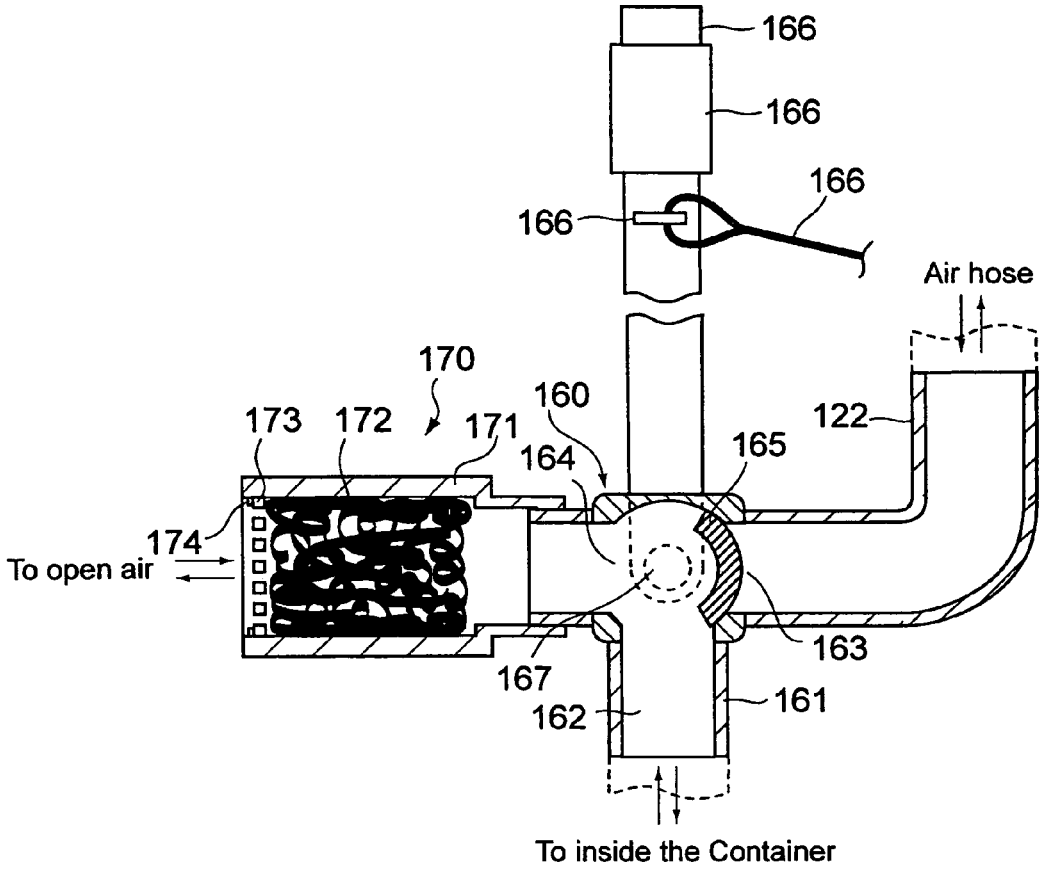
FIG. 14 is a schematic diagram showing the structure in the vicinity of the three-way value according to another embodiment of the present invention.

1 Container
2 Container Body
4 Pipe
31 Outlet
40 Reception dish
41 Fulcrum
42 Holding member
44 Wire
**44*b*** Joint
50 Forklift truck
51 Fork
52 Fork
53 Lifting mechanism
55 Reserve tank
56 Air compressor
59 Wire pull and return mechanism
60 Air cylinder
61 Drive shaft
101 Container
102 Container Body
104 Pipe
119 Passage for internal pressure control
122 Pipe for applying and reducing pressure
131 Outlet
140 Reception dish
141 Fulcrum
142 Holding member
144 Wire
160 Three-way valve
162 First valve opening
163 Second valve opening
164 Third valve opening
165 Valve member
166 Operation lever
170 Breather

What is claimed is:

1. A molten metal supplying system, comprising:

(1) a container having:

a portable container main body capable of being hermetically sealed and storing molten metal, that has a passage through which a compressed gas is introduced from an outside;

a pipe that has an outlet and supplies the molten metal stored in the container main body to the outside: the outlet downwardly extending;

a reception dish that receives the molten metal and that is capable of being placed below the outlet of the pipe;

a holding member that has a fulcrum to the pipe and rotatably holds the reception dish;

a wire that has a first end and a second end, the first end of which being connected to at least one of the reception dish and the holding member; and a pair of channel members disposed at the outer bottom of the container main body in a first direction, and (2) a vehicle having:

a fork that is inserted into the pair of channel members and removed therefrom;

a carriage on which the fork is mounted;

a lift mechanism that lifts up and down the carriage; and a wire pull and return mechanism that is mounted on the carriage and pulls and returns the wire with the second end thereof.

2. The molten metal supplying system as set forth in claim 1, wherein the pipe extends in an outer-peripheral direction of the container main body in a second direction that is different from the first direction, and wherein the wire pull and return mechanism is mounted on the carriage in a third direction that is approximately opposite to the second direction.

3. The molten metal supplying system as set forth in claim 1, wherein the vehicle has at least one of a gas compressor and a gas tank that supplies compressed gas to the container main body, and wherein the wire pull and return mechanism has an air cylinder that is driven by a compressed gas supplied from at least one of the gas compressor and the gas tank.

4. The molten metal supplying system as set forth in claim 3, wherein the vehicle has:

means for detecting the position of a drive shaft of the air cylinder; and means for controlling the gas supplied from at least one of the gas compressor and the gas tank to the container main body corresponding to the detected position.

5. A container, comprising:

a portable container main body capable of being hermetically sealed and storing molten metal, that has a passage through which a compressed gas is introduced from an outside;

a pipe that has an outlet and supplies the molten metal stored in the container main body to the outside: the outlet downwardly extending;

a reception dish that receives the molten metal and that is capable of being placed below the outlet of the pipe; and a holding member that has a fulcrum to the pipe and rotatably holds the reception dish.

6. The container as set forth in claim 5, further comprising:

a wire that has a first end and a second end, the first end thereof is connected to at least one of the reception dish and the holding member and the second end thereof is capable of being connected to a wire pull and return mechanism.

7. The container as set forth in claim 6, further comprising:

a pair of channel members disposed at an outer bottom of the container main body in a first direction and into and from which a fork disposed in a vehicle that conveys the container is inserted and removed, wherein the pipe extends in an outer-peripheral direction of the container main body in a second direction that is different from the first direction, and wherein the second end of the wire is pulled in a third direction approximately opposite to the second direction.

8. The container as set forth in claim 7, wherein the angle between the first direction and the second direction is approximately 45 degrees.

9. A container, comprising:

a portable container main body capable of being hermetically sealed and storing molten metal, that has a passage through which a compressed gas is introduced from an outside;

a pipe that has an outlet and supplies the molten metal stored in the container main body to the outside: the outlet downwardly extending;

a reception dish that receives the molten metal and that is capable of being placed below the outlet of the pipe;

a holding member that has a fulcrum to the pipe and rotatably holds the reception dish between a first position in which the holding member is placed underneath the outlet of the pipe and a second position in which the holding member is retreated from the underneath of the outlet of the pipe;

a wire that has a first end and a second end, the first end is connected to at least one of the reception dish and the holding member;

a valve that has a first valve opening leading to the passage of the container main body, a second valve opening leading to a pipe for applying and reducing pressure, and a third valve opening leading to an air release portion and that has a first mode in which the gas flows between the first valve opening and the third valve opening and a second mode in which the gas flows between the first valve opening and the second valve opening; and an operation lever that is connected to the other end of the wire and to the valve, that is manually rotatable between a first operation position and a second operation position, that causes the valve to be placed in the first mode and the reception dish to be placed in the first position when placed in the first operation position, and that causes the valve to be placed in the second mode and the reception dish to be placed in the second position when placed in the second operation position.

10. The container as set forth in claim 9, wherein the reception dish is rotatably mounted to the holding member.

11. The container as set forth in claim 9, further comprising:

a flow restriction portion that is disposed between the third valve opening of the valve and the air release portion, that allows gas to pass to flow, and that restricts the flow of molten metal.

* * * * *